US006308470B1

(12) United States Patent
Durkovic

(10) Patent No.: US 6,308,470 B1
(45) Date of Patent: Oct. 30, 2001

(54) WATER SEEPAGE CONTROLLING DEVICE

(76) Inventor: Savo Durkovic, 2304 Antibes Drive, Toronto, Ontario (CA), M2R 2Z1

( * ) Notice: Subject to any disclaimer, the term of this patent is extended or adjusted under 35 U.S.C. 154(b) by 0 days.

(21) Appl. No.: 09/497,928

(22) Filed: Feb. 4, 2000

(51) Int. Cl.[7] ..... E02D 19/00; E04B 1/70
(52) U.S. Cl. ..... 52/169.5; 52/302.3; 405/36
(58) Field of Search ..... 52/169.5, 478, 52/169.8, 533, 302.1, 302.3, 310, 508, 293.1, 506.01, 506.05, 510; 405/43, 36

(56) References Cited

U.S. PATENT DOCUMENTS

| | | | | |
|---|---|---|---|---|
| D. 329,297 | | 9/1992 | Smith . | |
| 3,850,193 | * | 11/1974 | Guzzo | 137/362 |
| 4,045,964 | | 9/1977 | Barclay . | |
| 4,840,515 | | 6/1989 | Freese . | |
| 5,035,095 | | 7/1991 | Bevilacqua . | |
| 5,501,044 | * | 3/1996 | Janesky | 52/169.5 |
| 5,630,299 | * | 5/1997 | Jackman et al. | 52/169.5 |
| 5,761,858 | | 6/1998 | Watanabe et al. . | |
| 5,784,838 | * | 7/1998 | Phillips | 52/169.5 |
| 5,794,388 | | 8/1998 | Jackman . | |
| 5,809,731 | | 9/1998 | Reiss . | |
| 6,023,892 | * | 2/2000 | Sourlis | 52/169.5 |

* cited by examiner

*Primary Examiner*—Carl D. Friedman
*Assistant Examiner*—Jennifer I. Thissell

(57) ABSTRACT

A water seepage controlling device for draining away water from between an inner wall and an edge of a foundation wall. The water seepage controlling device includes a device positionable between a front surface of an inner wall and a peripheral edge of a foundation wall. The device has a base panel. The base panel is elongate having laterally spaced first and second opposing edges. A first panel controls water seepage and abuts against the front surface of the inner wall. The first panel has a first and second edge. The first edge of the first panel is fixedly coupled to the first edge of the base panel. The first panel is oriented generally perpendicular to the base panel. A second panel controls water seepage and abuts against the peripheral edge of the foundation wall. The second panel has a first and second edge. The first edge of the first panel is fixedly coupled to the base panel. The second panel is oriented generally perpendicular to the base panel. The second panel extends in an opposite direction from the base panel than the first panel.

10 Claims, 4 Drawing Sheets

WATER SEEPAGE CONTROLLING DEVICE

BACKGROUND OF THE INVENTION

1. Field of the Invention

The present invention relates to foundation draining devices and more particularly pertains to a new water seepage controlling device for draining away water from between an inner wall and an edge of a foundation wall.

2. Description of the Prior Art

The use of foundation draining devices is known in the prior art. More specifically, foundation draining devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,809,731; 5,794,388; 4,045,964; 5,035,095; 4,840,515; 5,761,858; and U.S. Des. Pat. No. 329,297.

While these devices fulfill their respective, particular objectives and requirements, the aforementioned patents do not disclose a new a water seepage controlling device for controlling water seepage. The device is positionable between a front surface of an inner wall and a peripheral edge of a foundation wall. The device has a base panel. The base panel is elongate having laterally spaced first and second opposing edges. A first panel controls water seepage and abuts against the front surface of the inner wall. The first panel has a first and second edge. The first edge of the first panel is fixedly coupled to the first edge of the base panel. The first panel is oriented generally perpendicular to the base panel. A second panel controls water seepage and abuts against the peripheral edge of the foundation wall. The second panel has a first and second edge. The first edge of the first panel is fixedly coupled to the base panel. The second panel is oriented generally perpendicular to the base panel. The second panel extends in an opposite direction from the base panel than the first panel.

In these respects, the water seepage controlling device according to the present invention substantially departs from the conventional concepts and designs of the prior art, and in so doing provides an apparatus primarily developed for the purpose of draining away water from between an inner wall and an edge of a foundation wall.

SUMMARY OF THE INVENTION

In view of the foregoing disadvantages inherent in the known types of foundation draining devices now present in the prior art, the present invention provides a new water seepage controlling device construction wherein the same can be utilized for draining away water from between an inner wall and an edge of a foundation wall.

The general purpose of the present invention, which will be described subsequently in greater detail, is to provide a new water seepage controlling device apparatus and method which has many of the advantages of the foundation draining devices mentioned heretofore and many novel features that result in a new water seepage controlling device which is not anticipated, rendered obvious, suggested, or even implied by any of the prior art foundation draining devices, either alone or in any combination thereof.

To attain this, the present invention generally comprises a device positionable between a front surface of an inner wall and a peripheral edge of a foundation wall. The device has a base panel. The base panel is elongate having laterally spaced first and second opposing edges. A first panel controls water seepage and abuts against the front surface of the inner wall. The first panel has a first and second edge. The first edge of the first panel is fixedly coupled to the first edge of the base panel. The first panel is oriented generally perpendicular to the base panel. A second panel controls water seepage and abuts against the peripheral edge of the foundation wall. The second panel has a first and second edge. The first edge of the first panel is fixedly coupled to the base panel. The second panel is oriented generally perpendicular to the base panel. The second panel extends in an opposite direction from the base panel than the first panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water seepage controlling device apparatus and method which has many of the advantages of the foundation draining devices mentioned heretofore and many novel features that result in a new water seepage controlling device which is not anticipated, rendered obvious, suggested, or even implied by any of the prior art foundation draining devices, either alone or in any combination thereof.

It is another object of the present invention to provide a new water seepage controlling device which may be easily and efficiently manufactured and marketed.

It is a further object of the present invention to provide a new water seepage controlling device which is of a durable and reliable construction.

An even further object of the present invention is to provide a new water seepage controlling device which is susceptible of a low cost of manufacture with regard to both materials and labor, and which accordingly is then susceptible of low prices of sale to the consuming public, thereby making such water seepage controlling device economically available to the buying public.

Still yet another object of the present invention is to provide a new water seepage controlling device which provides in the apparatuses and methods of the prior art some of the advantages thereof, while simultaneously overcoming some of the disadvantages normally associated therewith.

Still another object of the present invention is to provide a new water seepage controlling device for draining away water from between an inner wall and an edge of a foundation wall.

Yet another object of the present invention is to provide a new water seepage controlling device which includes a device positionable between a front surface of an inner wall and a peripheral edge of a foundation wall. The device has a base panel. The base panel is elongate having laterally spaced first and second opposing edges. A first panel controls water seepage and abuts against the front surface of the inner wall. The first panel has a first and second edge. The first edge of the first panel is fixedly coupled to the first edge of the base panel. The first panel is oriented generally perpendicular to the base panel. A second panel controls water seepage and abuts against the peripheral edge of the foundation wall. The second panel has a first and second edge. The first edge of the first panel is fixedly coupled to the base panel. The second panel is oriented generally perpendicular to the base panel. The second panel extends in an opposite direction from the base panel than the first panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
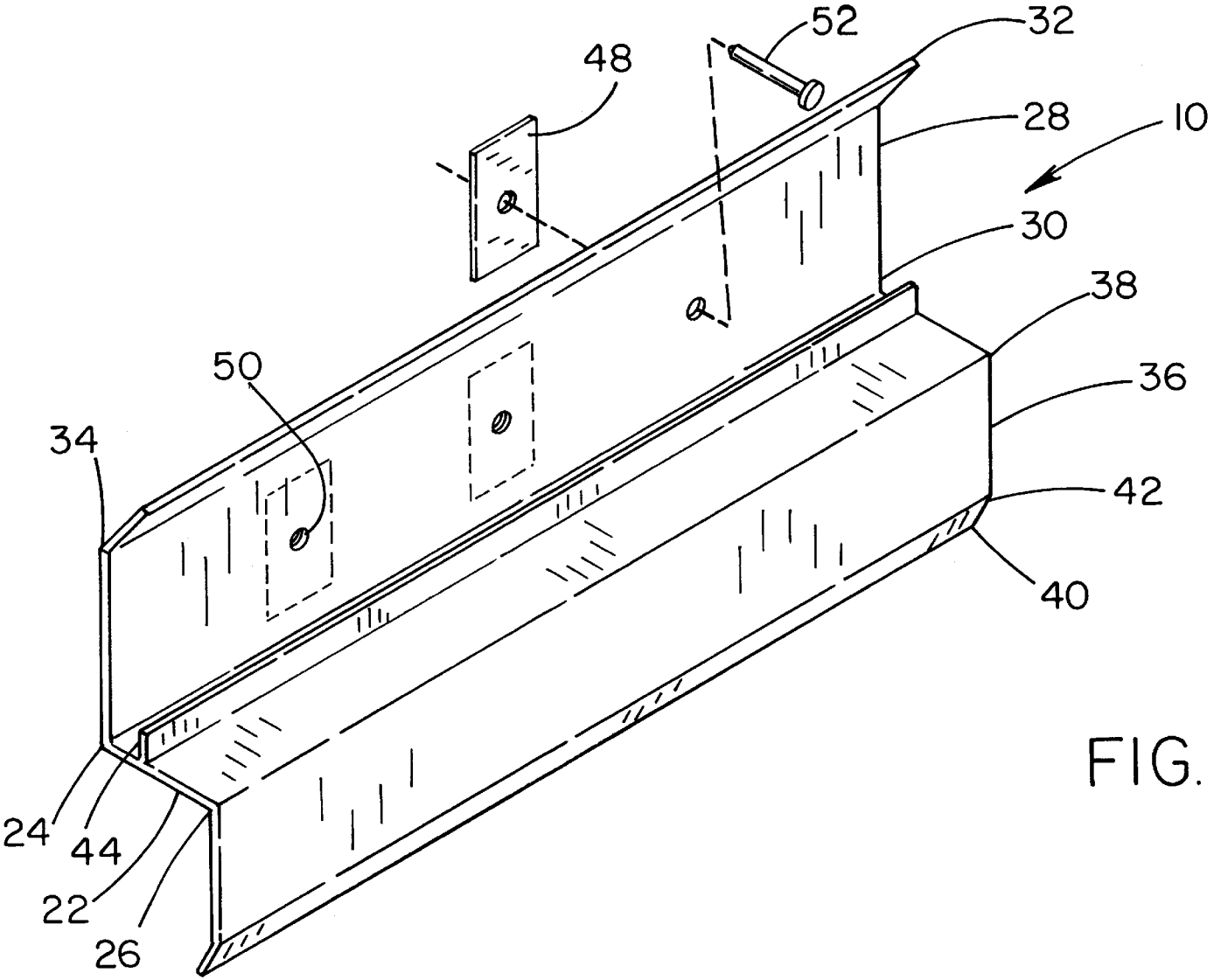
FIG. 1 is a schematic perspective view of a new water seepage controlling device according to the present invention.
Figure 2:
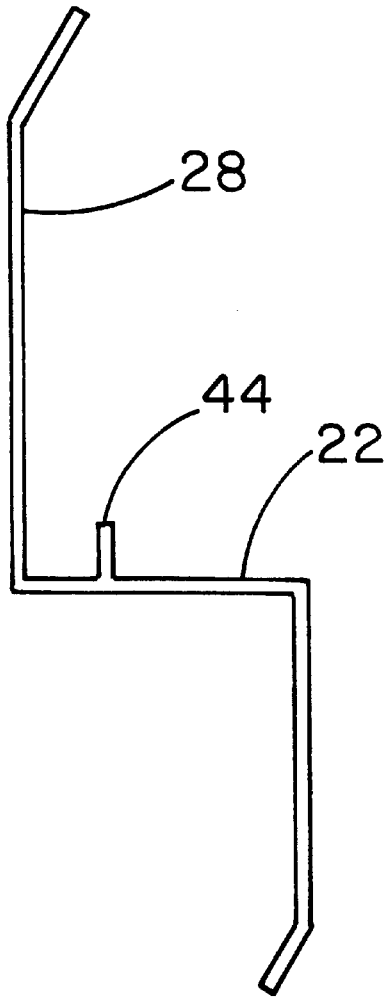
FIG. 2 is a schematic side view of the present invention.
Figure 3:
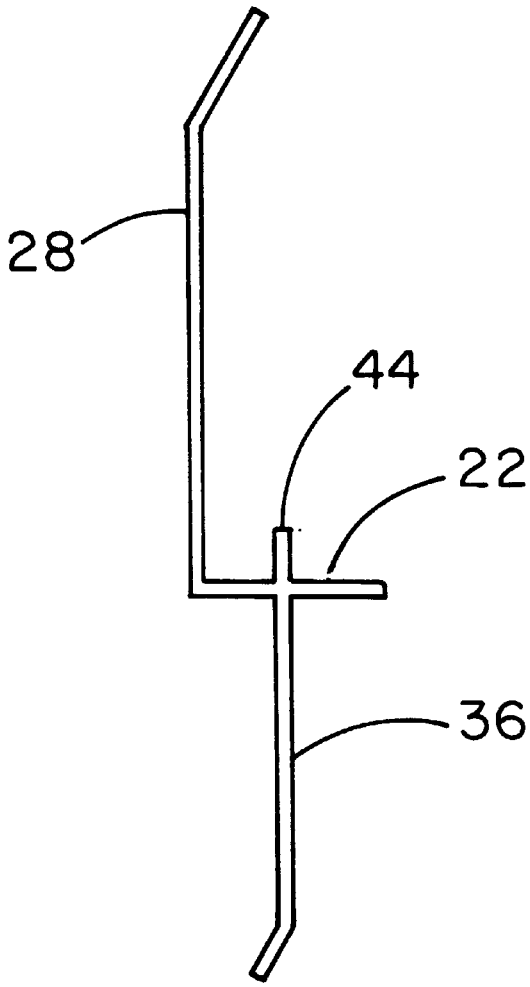
FIG. 3 is a schematic side view of a second embodiment of the present invention.
Figure 4:
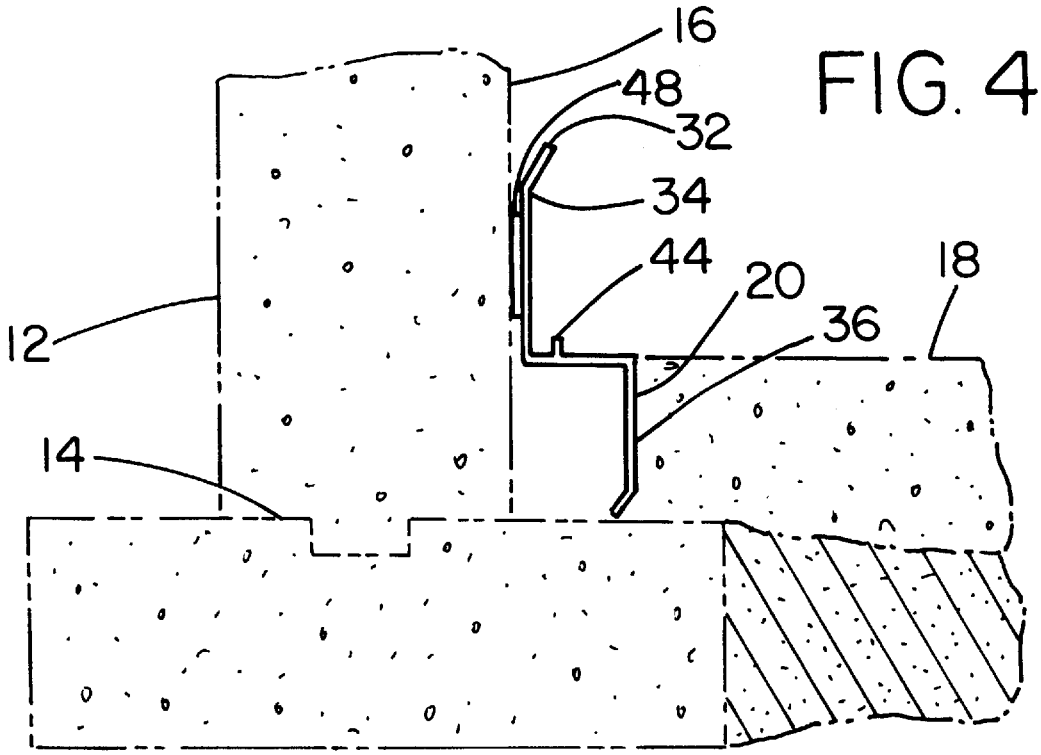
FIG. 4 is a schematic side view of the present invention.
Figure 5:
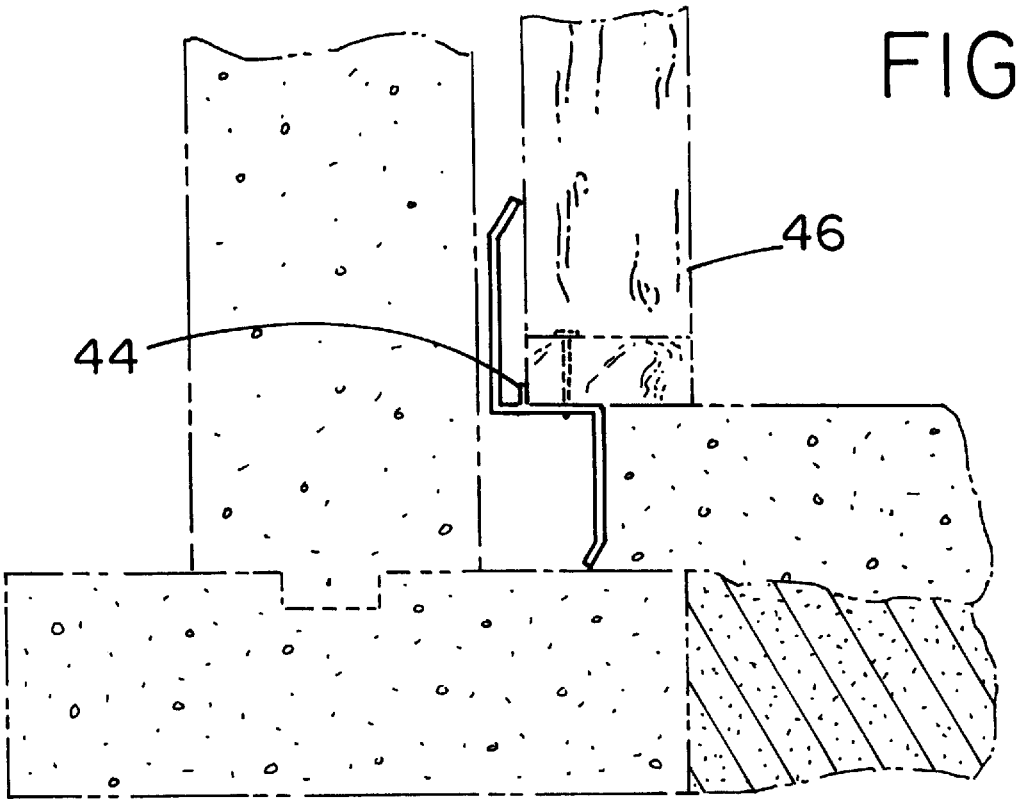
FIG. 5 is a schematic side view of the present invention.
Figure 6:
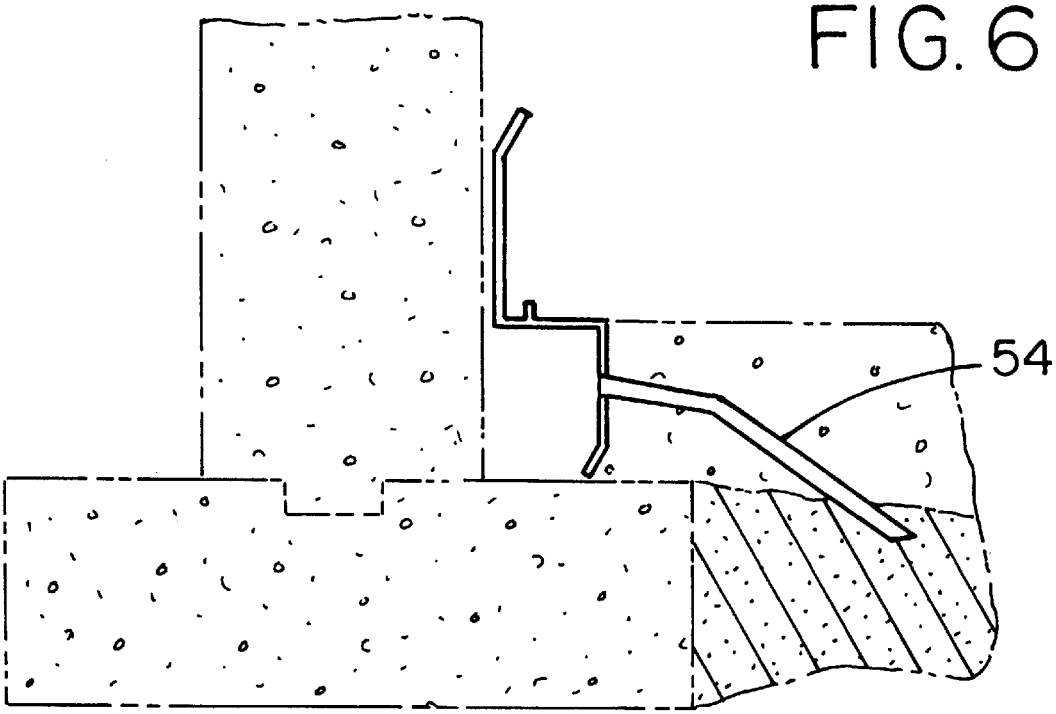
FIG. 6 is a schematic side view of the present invention.
Figure 7:
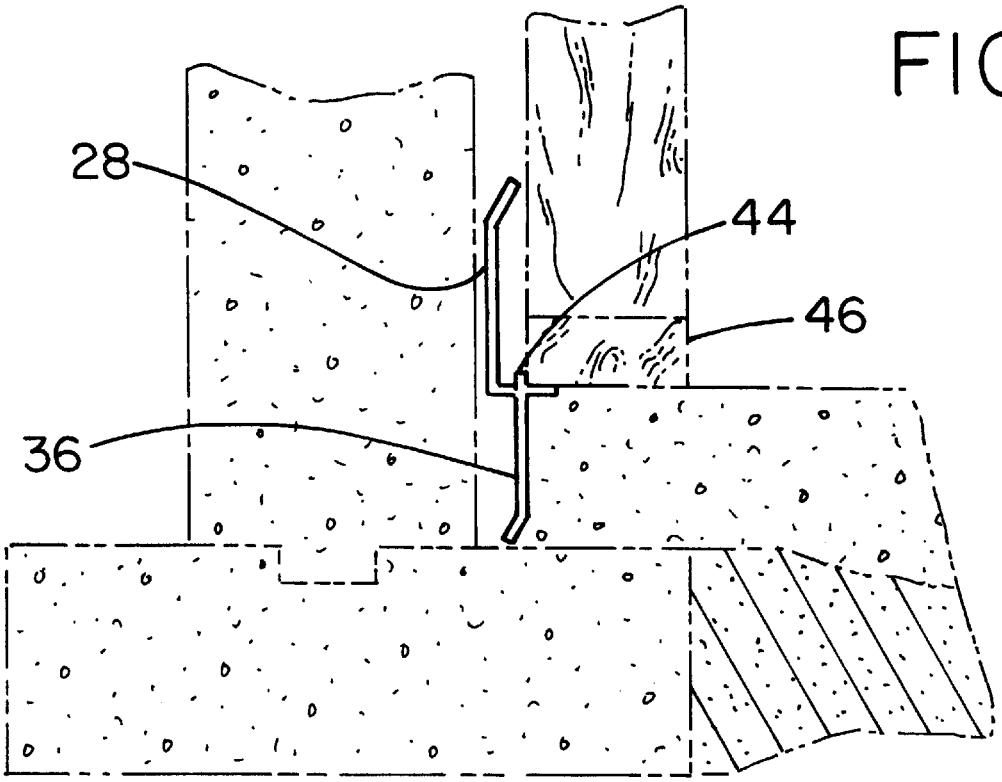
FIG. 7 is a schematic side view of the second embodiment of the present invention.

With reference now to the drawings, and in particular to FIGS. 1 through 7 thereof, a new water seepage controlling device embodying the principles and concepts of the present invention and generally designated by the reference numeral 10 will be described.

As best illustrated in FIGS. 1 through 7, the water seepage controlling device 10 generally comprises an inner wall 12 having a bottom edge 14 and a front surface 16. The inner wall 12 is generally vertically orientated. A foundation wall 18 has a perimeter edge 20. The foundation wall 18 is a floor slab. The inner wall 12 is spaced from the foundation wall 18.

A base panel 22 is elongate. The base panel is generally planar and has laterally spaced first 24 and second 26 opposing edges. The base panel 22 has a generally rectangular shape.

A first panel 28 for controlling water seepage and for abutting against the front surface 16 of the inner wall 12 has a first 30 and second 32 edge. The first edge 30 of the first panel 28 is fixedly coupled to the first edge 24 of the base panel 22. The first panel 28 is oriented generally perpendicular to the base panel 24. The first panel 28 has a bend 34 therein such that the second edge 32 of the first panel 28 extends away from the front surface 16 of the inner wall 12.

A second panel 36 controls water seepage and abuts against the peripheral edge 20 of the foundation wall 18. The second panel 36 has a first 38 and second edge 40. Preferably, the first edge 38 of the second panel 36 is fixedly coupled to the second edge 26 of the base panel 22. In another embodiment, best depicted in FIGS. 3 and 7, the first edge of the second panel is coupled to the base panel at a location between the first 24 and second edges 26 of the base panel 22. The second panel 36 is oriented generally perpendicular to the base panel 22. The second panel 36 extends in an opposite direction from the base panel than the first panel 28. The second panel 36 has a bend 42 therein such that the second edge 40 of the second panel 36 extends toward the front surface 16 of the inner wall 12.

A third panel 44 for positioning against a support beam 46 is fixedly coupled to a top surface of the base panel 22. The third panel 44 extends away from the base panel 22 in a direction generally identical to the first panel 28. The third panel 44 is located such that a line connecting the second edge 32 of the first panel 28 and the third panel 44 is oriented generally perpendicular to the base panel.

A plurality of spacers 48 space the first panel 28 from the front surface 16 of the inner wall 12. Each of the spacers 48 is a plate having a generally rectangular shape. Ideally, there are three spaces for each device.

A plurality of bores 50 is in the first panel 28. Each of the bores 50 is located generally between the first 30 and second 32 edges of the first panel 28. Ideally, there are three bores 50.

A plurality of fastening means 52 fasten each of the plates 48 to the first panel. Each of the fastening means 52 extends through one of the bores 50 and the plates 48. Ideally, each of the fastening means is a nail.

A drain 54 removes water from the space between the inner wall 12 and the peripheral edge 20 of the foundation wall 18. The drain 54 is fluidly coupled to a bore in the second panel 36. Ideally, the drain 54 is a tube directing water away from the space.

In use, multiple devices 10 can be used in conjunction with each other to line the space between the inner wall 12 and the foundation wall 18. If water seeps between the inner wall 12 and the support beam 46, the water will travel behind the first panel 28 to a space below the base panel 22. There it will evaporate or be drained to away to the septic system or other drainage area. The support beams 46, or studs, and the walls they support, will remain dry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water seepage controlling device for controlling water seepage, said device being positionable between a front surface of an inner wall and a peripheral edge of a foundation wall, said device comprising:

a base panel, said base panel being elongate, said base panel having laterally spaced first and second opposing edges;

a first panel for controlling water seepage for abutting against said front surface of said inner wall, said first panel having a first and second edge, said first edge of said first panel being fixedly coupled to said first edge of said base panel, said first panel being oriented generally perpendicular to said base panel; and a second panel for controlling water seepage for abutting against said peripheral edge of said foundation wall, said second panel having a first and second edge, said first edge of said second panel being fixedly coupled to said base panel, said second panel being oriented generally perpendicular to said base panel, said second panel extending in an opposite direction from said base panel than said first panel;

said first panel having a bend therein such that said second edge of said first panel extends away from said inner wall when said device is positioned between the inner wall and the peripheral edge;

said second panel having a bend therein such that said second edge of said second panel extends toward said inner wall when said device placed between the inner wall and the peripheral edge.

2. The water seepage controlling device for controlling water seepage as in claim 1, further including:

a third panel, said third panel being fixedly coupled to a top surface of said base panel, said third panel extending away from said base panel in a direction generally identical to said first panel, said third panel being located generally between said first and second edges of said base panel.

3. The water seepage controlling device for controlling water seepage as in claim 1, further including:

a plurality of spacers for spacing said first panel from the front surface of said inner wall, each of said spacers being a plate;

a plurality of bores, each of said bores being in said first panel, each of said bores being located generally between said first and second edges of said first panel; and a plurality of fastening means for fastening each of said plates to said first panel, each of said fastening means extending through one of said bores and said plates.

4. A water seepage controlling device for controlling water seepage, said device comprising:

an inner wall, said inner wall having a bottom edge and a front surface, said inner wall being generally vertically orientated;

a foundation wall, said foundation wall having a perimeter edge, said foundation wall being a floor slab;

wherein said inner wall is spaced from said foundation wall;

a base panel, said base panel being elongate, said base panel being generally planar, said panel having laterally spaced first and second opposing edges, said panel having a generally rectangular shape;

a first panel for controlling water seepage for abutting against said front surface of said inner wall, said first panel having a first and second edge, said first edge of said first panel being fixedly coupled to said first edge of said base panel, said first panel being oriented generally perpendicular to said base panel, said first panel having a bend therein such that said second edge of said first panel extends away from said front surface of said inner wall;

a second panel for controlling water seepage for abutting against said peripheral edge of said foundation wall, said second panel having a first and second edge, said first edge of said second panel being fixedly coupled to said second edge of said base panel, said second panel being oriented generally perpendicular to said base panel, said second panel extending in an opposite direction from said base panel than said first panel, said second panel having a bend therein such that said second edge of said second panel extends toward said front surface of said inner wall;

a third panel for positioning against a support beam, said third panel being fixedly coupled to a top surface of said base panel, said third panel extending away from said base panel in a direction generally identical to said first panel, said third panel being located generally adjacent to said first panel such that a line connecting said second edge of said first panel and said third panel is oriented generally perpendicular to said base panel;

a plurality of spacers for spacing said first panel from the front surface of said inner wall, each of said spacers being a plate, each of said plates having a generally rectangular shape, said plurality of spacers being three spacers;

a plurality of bores, each of said bores being in said first panel, each of said bores being located generally between said first and second edges of said first panel, said plurality of bores being three bores;

a plurality of fastening means for fastening each of said plates to said first panel, each of said fastening means extending through one of said bores and said plates, each of said fastening means being a nail;

a drain for removing water from the space between said inner wall and said peripheral edge of said foundation wall, said drain being fluidly coupled to a bore in said second panel, said drain comprising a tube, said tube directing water away from said space.

5. A water seepage controlling device positionable between a front surface of an inner wall and a peripheral edge of a foundation wall, said device comprising:

an elongate base panel having laterally spaced first and second opposite edges;

a first panel for abutting against said front surface of said inner wall, said first panel having a first edge and a second edge, said first edge of said first panel being fixedly coupled to said first edge of said base panel, said first panel being oriented generally perpendicular to said base panel; and a second panel for abutting against said peripheral edge of said foundation wall, said second panel having a first edge and a second edge, said first edge of said second panel being fixedly coupled to said base panel, said second panel being oriented generally perpendicular to said base panel, said second panel extending in an opposite direction from said base panel than said first panel;

said first panel having a bend therein such that said second edge of said first panel extends away from said inner wall when said device is positioned between the inner wall and th e peripheral edge;

said second panel having a bend therein such that said second edge of said second panel extends toward said inner wall when said device placed between the inner wall and the peripheral edge.

6. The water seepage controlling device as in claim 5, further including a third panel being fixedly coupled to a top surface of said base panel, said third panel extending away from said base panel in a direction generally identical to said first panel, said third panel being located generally between said first and second edges of said base panel.

7. The water seepage controlling device as in claim 5, further including a plurality of spacers for spacing said first panel from the front surface of said inner wall.

8. The water seepage controlling device as in claim 7, wherein each of said spacers comprises a plate.

9. The water seepage controlling device as in claim 7, additionally comprising a plurality of fastening means for fastening each of said spacers to said first panel.

10. The water seepage controlling device as in claim 5, wherein a plurality of bores is formed in said first panel.

* * * * *